US008146170B2

(12) United States Patent
Goodhand et al.

(10) Patent No.: US 8,146,170 B2
(45) Date of Patent: Apr. 3, 2012

(54) PANT FOR A HOCKEY PLAYER

(75) Inventors: Stephen Goodhand, Kirkland (CA); David Rudd, Vaudreuil-Dorion (CA)

(73) Assignee: Bauer Hockey, Inc., Exeter, NH (US)

( * ) Notice: Subject to any disclaimer, the term of this patent is extended or adjusted under 35 U.S.C. 154(b) by 448 days.

(21) Appl. No.: 12/541,525

(22) Filed: Aug. 14, 2009

(65) Prior Publication Data

US 2010/0043123 A1 Feb. 25, 2010

Related U.S. Application Data

(60) Provisional application No. 61/089,903, filed on Aug. 19, 2008.

(51) Int. Cl.
*A41D 13/06* (2006.01)

(52) U.S. Cl. ..... 2/22; 2/227

(58) Field of Classification Search ..... 2/235–238, 2/227, 220, 22, 23, 400–406, 464, 465, 467, 2/44

See application file for complete search history.

(56) References Cited

U.S. PATENT DOCUMENTS

| | | | | |
|---|---|---|---|---|
| 4,325,148 | A | 4/1982 | Livernois | |
| 4,811,427 | A | 3/1989 | Regan | |
| 5,539,927 | A * | 7/1996 | Holubec | 2/69 |
| 5,926,856 | A * | 7/1999 | Duval | 2/455 |
| 6,701,533 | B2 * | 3/2004 | Webb | 2/303 |
| 6,782,559 | B2 | 8/2004 | Regan | |
| 6,804,832 | B2 | 10/2004 | Béland | |
| 7,937,767 | B2 | 5/2011 | Leach et al. | |
| 2006/0282938 | A1 * | 12/2006 | Jewell et al. | 2/227 |
| 2007/0101474 | A1 * | 5/2007 | Skottheim et al. | 2/69 |

FOREIGN PATENT DOCUMENTS

CA 2464782 A1 10/2005

* cited by examiner

*Primary Examiner* — Danny Worrell

(57) ABSTRACT

A pant for a hockey player. The pant comprises an inner pant and an outer shell releasably connected to a waist portion of the inner pant and wherein the inner pant has several protective pads, a pocket for receiving a cup for protecting the genital area of the player and respective left and right VELCRO tabs for affixing hockey socks to the inner pant.

14 Claims, 5 Drawing Sheets

PANT FOR A HOCKEY PLAYER

CROSS-REFERENCE TO RELATED APPLICATIONS

This application claims priority to U.S. Provisional Application No. 61/089,903, which was filed on Aug. 19, 2008, the contents of which are incorporated herein by reference in their entirety.

FIELD OF THE INVENTION

This application relates to a pant for a hockey player. The pant comprises an inner pant and an outer shell releasably connected to a waist portion of the inner pant and wherein the inner pant has several protective pads, a pocket for receiving a cup for protecting the genital area of the player and respective left and right VELCRO tabs for affixing hockey socks to the inner pant.

BACKGROUND OF THE INVENTION

Traditionally, hockey pants have been made of a strong nylon construction and completely cover the midportion or torso of a hockey player. Such pants are usually generally formed as an oversized pair of shorts and are constructed as a single piece of equipment. This single piece of equipment, however, included several protective elements and padding.

Recently, manufacturers have taken new approaches for hockey pants. More specifically, upon recognizing the expense of such pants, and recognizing that players often play for more than one team which may have different team colors, two-piece hockey pants have been developed in which an inner pant is mated with a removable outer shell. Thus, a player can purchase multiple outer shells in different colors to use with a single inner pant. Additionally, as most of the wear and tear of hockey pants is focused on the outer shell, replacement of only the outer shell instead of the entire pant further reduces expense.

Traditionally, hockey players also wear a separate short having a waistband which is elastically supported at the player's waist. The short has a pocket adjacent its crotch portion for receiving a genital protector. The pocket is positioned to overlay the genital area when the waistband is maintained at the player's waist thereby ensuring proper protection. Each leg portion of the short has front and back tabs with VELCRO loops or VELCRO hooks for supporting the socks.

Accordingly, there is a need in the art for improved a hockey pant that offers more versatility, while offering proper protection and minimizing any restriction of player movement.

SUMMARY OF THE INVENTION

As embodied and broadly described herein, the present invention provides a pant for a hockey player having a lower spine region, lower ribs, a waist region, a pelvic region with left and right hips, a crotch region, a genital area, and left and right thighs, the pant comprising: (a) an inner pant comprising a waist portion for covering the waist region of the player, a pelvic portion with front and rear panels for covering the pelvic region of the player, a crotch portion for covering the crotch region of the player and left and right leg portions for covering at least partially the left and right thighs of the player, the inner pant further comprising left and right hip pads for covering the left and right hips of the player, left and right upper thigh pads partially overlapping the respective left and right hip pads for at least partially covering the left and right thighs and being slightly movable relative to the respective left and right hip pads, the inner pant being at least partially made of compression material for applying compression to the player's body and holding the left and right hip pads relative to the respective left and right hips, the inner pant further comprising a pocket for receiving a cup for protecting the genital area of the player and wherein each of the left and right leg portions has a tab mounted adjacent its bottom end, the tap having affixing means for allowing attachment of a hockey sock to the inner pant; and (b) an outer shell at least partially covering the inner pant and being releasably connectable to the waist portion of the inner pant while being otherwise free to move relative to the inner pant, the outer shell having left and right leg sections covering the left and right leg portions of the inner pant, the left and right leg sections having respective left and right lower thigh pads for covering at least partially the left and right thighs of the player.

The invention also provides a pant for a hockey player having a lower spine region, lower ribs, a waist region, a pelvic region with left and right hips, a crotch region, a genital area, and left and right thighs, the pant comprising: (a) an inner pant comprising a waist portion for covering the waist region of the player, a pelvic portion with front and rear panels for covering the pelvic region of the player, a crotch portion for covering the crotch region of the player and left and right leg portions for covering at least partially the left and right thighs of the player, the inner pant further comprising left and right hip pads for covering the left and right hips of the player, left and right upper thigh pads partially overlapping the respective left and right hip pads for at least partially covering the left and right thighs and being slightly movable relative to the respective left and right hip pads, the inner pant being made of a first stretchable material and a second stretchable material capable of applying more pressure than the first stretchable material, the pelvic portion and left and right leg portions being at least partially made of the second stretchable material for holding the left and right hip pads relative to the respective left and right hips and the left and right upper thigh pads relative to the respective left and right thighs, the inner pant further comprising a pocket for receiving a cup for protecting the genital area of the player and wherein each of the left and right leg portions has a tab mounted adjacent its bottom end, the tap having affixing means for allowing attachment of a hockey sock to the inner pant; and (b) an outer shell at least partially covering the inner pant and being releasably connectable to the waist portion of the inner pant while being otherwise free to move relative to the inner pant, the outer shell having left and right leg sections covering the left and right leg portions of the inner pant, the left and right leg sections having respective left and right lower thigh pads for covering at least partially the left and right thighs of the player.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of the embodiments of the present invention is provided herein below, by way of example only, with reference to the accompanying drawings, in which.

Figure 1:
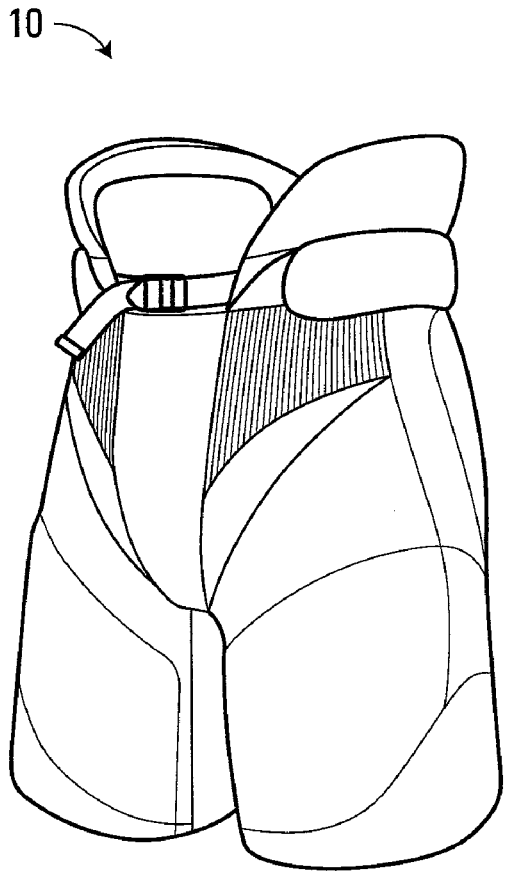
FIG. 1 is a front perspective view of a hockey pant in accordance with an embodiment of the present invention.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

The embodiments herein disclose pants that not only enable ease of replacement of an outer shell, but also include an inner pant that is specifically designed to maximize protection and performance, combined with an outer shell that is both versatile and specifically designed to work with the inner pant to maximize player performance and protection while minimizing any restriction of player movement.

Figure 2:
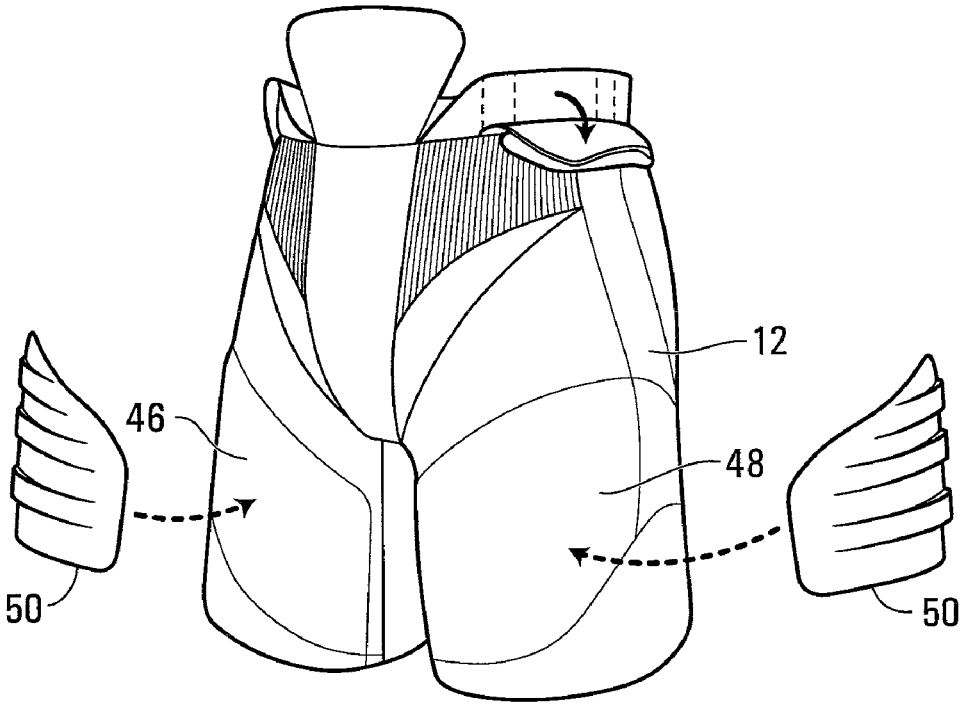
FIG. 2 is a front perspective view of the outer shell of FIG. 1.
Figure 3:
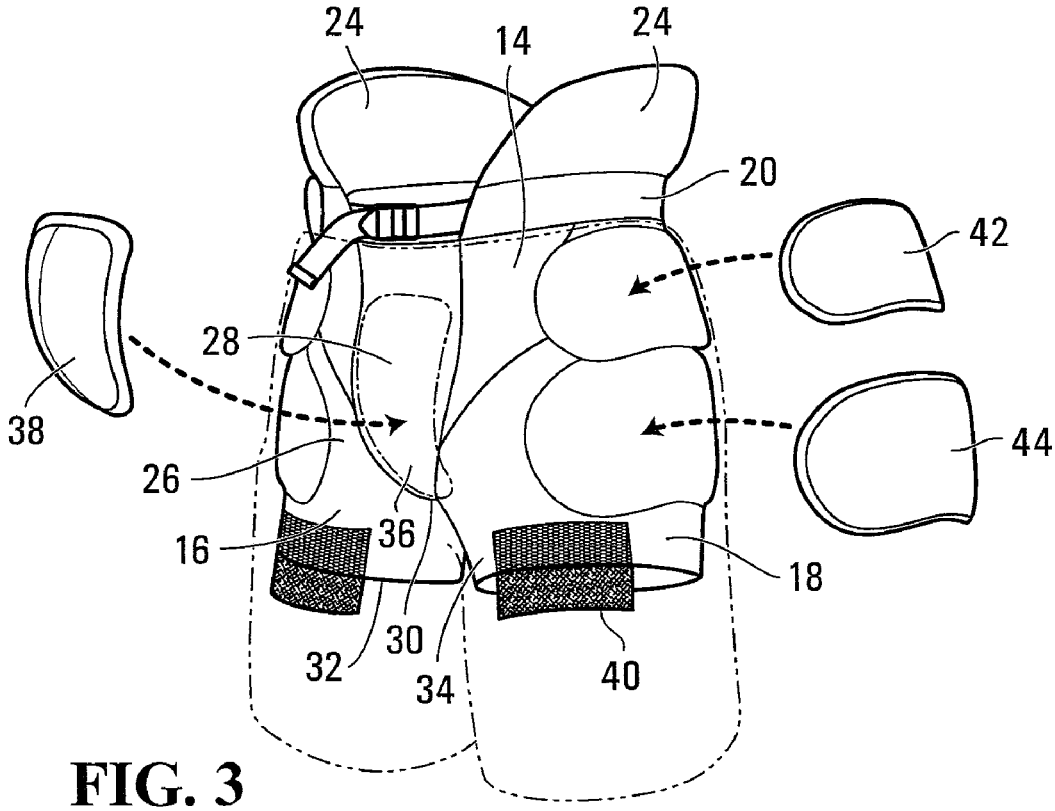
FIG. 3 is a front perspective view of the inner pant of FIG. 1.
Figure 4:
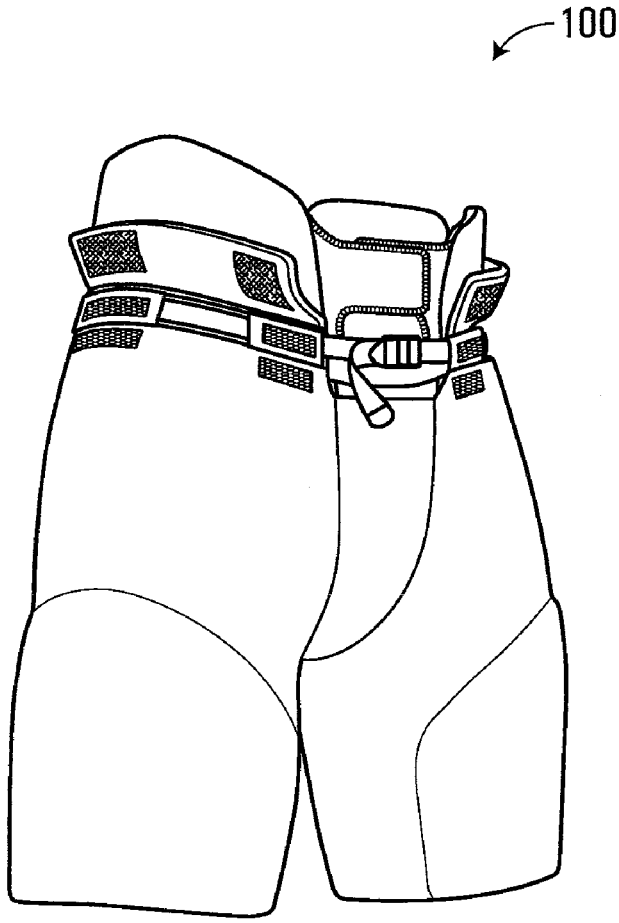
FIG. 4 is a front perspective view of a hockey pant in accordance with another embodiment of the present invention.
Figure 5:
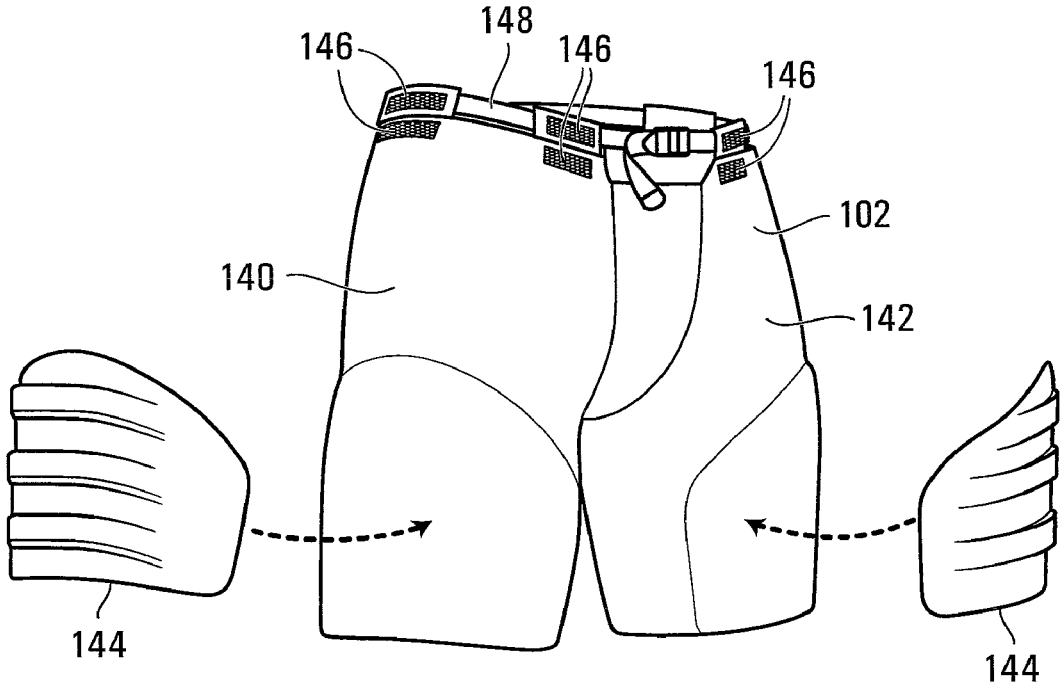
FIG. 5 is a front perspective view of the outer shell of FIG. 4.
Figure 6:
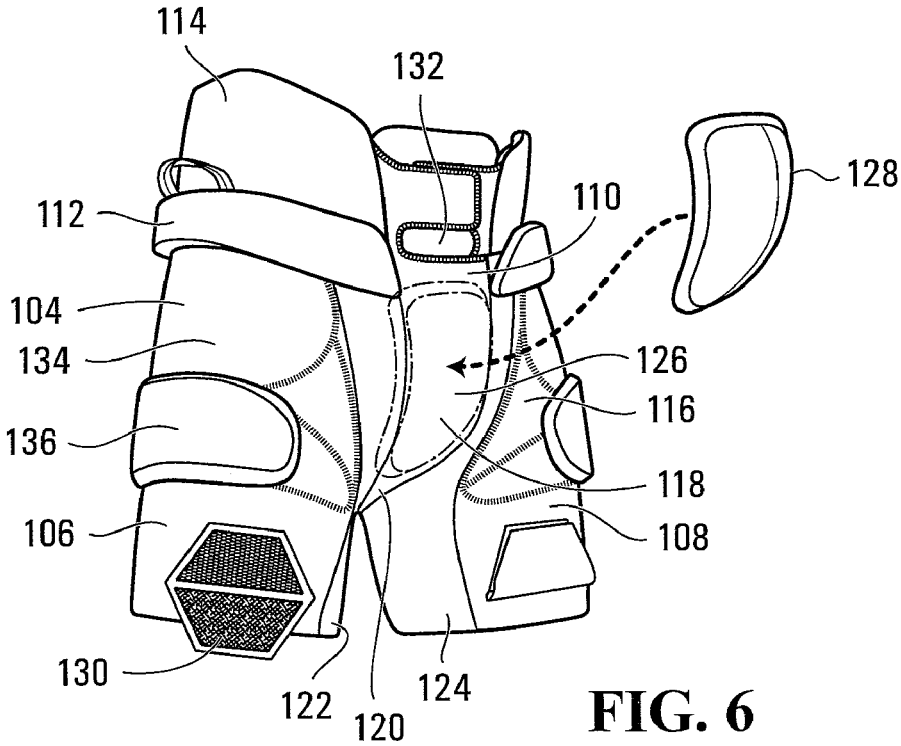
FIG. 6 is a front perspective view of the inner pant of FIG. 4.
Figure 7:
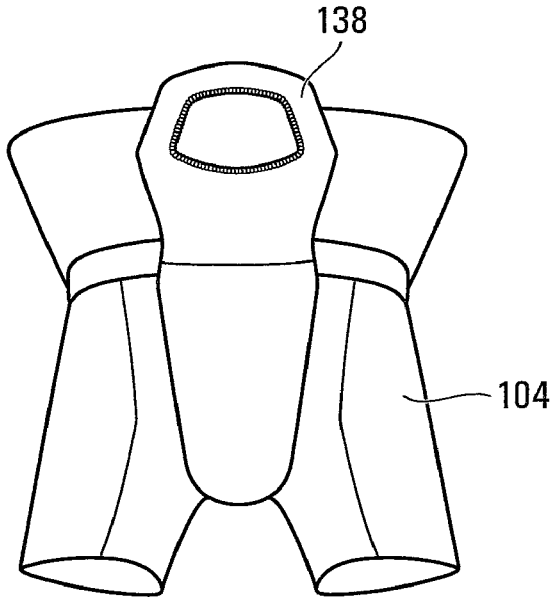
FIG. 7 is a rear view of the inner pant of FIG. 4.

FIGS. 1 and 4 show pants 10, 100 for a hockey player having a lower spine region, lower ribs, a waist region, a pelvic region with left and right hips, a crotch region, a genital area, and left and right thighs. FIGS. 2 and 5 show outer shells 12, 102 and FIGS. 3 and 6 show inner pants 14, 104 of the pants 10, 100. FIG. 7 is a rear view of the inner pant 104.

Each of the inner pant 12, 102 is in the form of a short or girdle and is adapted to at least partially cover the pelvic region and the left and right thighs of the player. The inner pant may be very tight-fitting, and thus closely holds pads associated therewith in a desired position on the player. Each of the inner pant 12, 102 has a right leg portion 16; 106 and a left leg portion 18, 108 for covering at least partially the respective right and left thighs of the player. The inner pant may have an elastic waist band portion 20; 110. As seen in FIG. 6, the inner pant may have a padded waist band 112 provided at and over the waist band portion. Kidney pads 24; 114 extend upwardly from the waist band on either side of the inner pant. The kidney pads enclose padding which is oriented, when worn, to protect the player's kidney areas on both sides of the body. The padding within the inner pant is curved and shaped so as to provide maximum protection while still maintaining player comfort.

The inner pant also comprises a pelvic portion 26; 116 with a front panel 28; 118 and a rear panel for covering the pelvic region of the player, a crotch portion 30; 120 for covering the crotch region of the player, an inner right leg portion 32; 122 and an inner left leg portion 34; 124. The inner pant has a pocket 36; 126 adapted to receive a cup 38; 128 for protecting the genital area of the player.

The inner pant is generally shaped as a compression short. The inner pant is at least partially made of compression material i.e. a material that is stretched so that when worn by the player, it fits snug and exerts compression on the player's thighs and/or the crotch region and/or the hip regions. For the most part, the inner pant is made of compression material adapted to tightly engage and exert a compressive force on the player's body. Compression fabric or high tenacity stretch fabric provides muscles with a firm compression fit that lessons vibrations, reduces fatigue, and keeps muscles energized when in a close fitting with the human body. The fabric is usually made in a knit construction, using a series of gradient fibers with an open knit inner surface to create a moisture transfer environment.

The compression material may be a stretch fabric comprising spandex fibers (LYCRA fibers).

That being said, the inner pant is also made of elastic materials that aid player mobility. In that sense, certain portions of the inner pant have enhanced elastic properties and the inner pant can be made of a first stretchable material and a second stretchable material capable of applying more pressure than said first stretchable material. In other words, the first stretchable material will be more "elastic" while the second material will offer more compression. It should be understood, however, that in other embodiments, all or most of the inner pant can be formed of stretch fabric having substantially the same compression stretch properties.

In one embodiment, the inner section of the respective left and right leg portions and each section of the front panel located adjacent the pocket 36; 126, can be made of stretch-vent-mesh fabric having improved stretch properties. The stretchable fabric for the front panel and inner leg portions may comprise a blend of a synthetic fiber and at least 10% of a stretchable fiber or it may be made of a blend of fibers selected from the group consisting of acetate, acrylic, nylon, olefin, polyester and rayon fibers with more than 10% spandex fibers or other elastic fibers such as LYCRA or rubber. The fabric can be a four-way stretch 85% nylon 15% spandex blend.

Each of the left and right leg portions of the inner pant further comprises a front tab 40; 130 and/or a rear tab adjacent the bottom end of each leg portion and each tab has VELCRO loops or VELCRO hooks allowing attachment of a hockey sock to the inner pant.

The VELCRO tabs are provided on the front and/or rear of the left and right leg portions, adjacent the bottom end of each leg portion. In the illustrated embodiment, the VELCRO tabs are adapted to generally fold over one another. In one embodiment, most of the tab is of one type of VELCRO (for example a hook-type), but a small tab preferably is of the opposite loop-type variety so that when the tab is folded closed, hooks and loops are engaged so as to help keep the tab closed. For instance, the upper tab has VELCRO loops and the below tab has VELCRO hooks. When the tabs are unfolded and opened, the VELCRO hooks are exposed and the player can pull the socks up his legs and attach them to the sock tabs in the front and/or back of leg portions of the inner pant. As such, the VELCRO tabs effectively stay tightly closed when not in use, but provide excellent bonding to the socks when engaged. When the tabs are folded closed, the VELCRO loops and hooks are blocked and do not interfere with the fit of the outer shell or with any other portion of the hockey pant. In one embodiment, the loop-portion tab of VELCRO is sufficiently small to not significantly interfere with the VELCRO connection between the socks and the tabs.

As shown in FIG. 6, the inner pant has stretchable stomach straps 132 extending between the kidney pads. One stretchable stomach strap may have VELCRO loops at one end while the other strap has VELCRO hooks at one end such that the straps are adapted to connect to each other to help keep the inner pant and kidney pads snug and in a correct position. As discussed above, the inner pant is formed of a compression-pant material and thus fits tightly about the player. However, the kidney pads extend upwardly from this tight-fitting material, and thus are not necessarily held snugly in place by the inner pant. The stretchable stomach straps that extend between the kidney pads enable the player to securely hold the kidney pads in a snug position so that they will not move or flop around during skating. Preferably, the padded waist band is attached to the inner pant so that it at least partially overlaps a portion of the kidney pads on both sides.

Each of the inner pants 10, 100 also comprises right and left hip pads 42; 134 and right and left upper thigh pads 44; 136 that can be attached to the inner pant in a sewn-in, or otherwise unitarily-attached configuration, preferably covered by fabric. It is to be understood, however, that in other embodiments, the inner pant may include pockets for accommodating such pads and the pads can be removable. Also, the pads do not necessarily require a fabric covering.

The hip pad is generally a large pad fitting over the player's hip, and the upper thigh pad is immediately below the player's hip without substantially overlapping thereon. In another embodiment, the upper thigh pad overlaps the lower portion of the hip pad. However, the upper thigh pad and hip pad are not rigidly connected to one another so that they move and adjust relative to one another as the player moves. The upper thigh pad may be appreciably longer from the fore to aft dimension than the hip pad. It is to be understood that, in further embodiments, the fore to aft length of the upper thigh pad can be greater than, less than, or the same as that same dimension of the hip pad.

The inner pant may comprise additional pads such as one or more perforated foam pads disposed in the inner leg section of the inner pant adjacent the crotch region of the player. Such pads preferably are relatively small and move relative to one another so as to accommodate movement of the player while still provide some protection.

As shown in FIG. 7, the inner pant 100 may also comprise a spine pad 138 inserted in a tailbone pocket located at a back portion of the inner pant. The spine pad extends upwardly from the waist band but is movable independently of the kidney pads. The spine pad may comprise a tailbone a hard section made of plastic (polycarbonate) sandwiched between foam. The spine pad is arranged within a rear central panel of the inner pant so as to extend downwardly adjacent the player's buttocks and curved so as to protect the player's tailbone in the case of falls and the like.

As indicated above, the inner pant has a pocket formed in the front panel of the inner pant into which a cup can selectively be inserted, adjusted, and held. Although the cup may be disposed on the outside of the inner pant, preferably the pocket is disposed within the inner pant so as to securely hold the cup therein. The cup pocket and tailbone pocket are disposed generally centrally in the front and rear panels of the inner pant. As discussed above, certain portions of the inner pant have especially-elastic stretchy fabric. Stretch zones are provided in the inner thighs and areas of the crotch immediately adjacent both the cup and tailbone pockets. Preferably these areas are especially configured to accommodate player movement, bending, stretching and the like, while the rest of the inner pant, though stretchy, maintains a compression pant-like fit on the player.

The compression pant-like fit of the inner pant provides an especially tight and snug placement of the inner pant around the pelvis region of the player. While this results in comfort for the player, it also enhances and ensures correct placement of the pads. For example, since the inner pant fits snug on the player, the hip pads 42; 134 will remain in position over the hips even during strenuous skating, so as to maintain better protection of the player. Also, the upper thigh pads 44; 136 will stay in their advantageous position. However, since they are not rigidly connected to the hip pads, they will move relative to the hip pads as the player moves. Since the snug-fitting inner pant keeps the pads in their correct positions relative to the player's body, player protection during skating is enhanced. Also, the kidney pads 24; 114 are snugly held in position against the player as the player engages the stomach pad VELCRO straps. Still further, the spine pad and cup are securely held in place in their respective pockets and, due to provision of the especially stretchy stretch zones adjacent these pockets, the spine pad and cup are maintained in the appropriate locations to provide protection.

As shown in FIGS. 1 and 4, the outer shell 12; 102 fits over the inner pant. The outer shell fits generally loosely around the player's legs, not exerting compression like the inner pant. Also, the outer shell has a mechanism for connecting to the connection mechanism of the inner pant selectively at different heights so that the effective length of the outer shell can be controlled by the player to accommodate a particular player's size and/or style.

In contrast to the inner pant, the outer shell is formed of a generally non-elastic material. However, the inner thigh region and/or the crotch region of the outer shell can be made of an elastic fabric so as to prevent resistance as the player skates aggressively.

The outer shell has right and left leg sections 46, 48; 140, 142, each having a relatively large lower thigh pad 50; 144 supported and held within the outer shell. When the outer shell is attached over the inner pant, the lower thigh pad 50; 144 partially overlaps the upper thigh pad which is held snugly within the inner pant. However, the lower thigh pad 50, 144 in the outer shell is not tightly attached to the player, and instead "floats" within the loose-fitting leg of the outer shell. Thus, as the player skates and moves about, the lower thigh pad moves readily up, down and around so as not to inhibit movement by the player. Preferably, the lower thigh pad is quite large and extends across most of the front and outer side of the player's thighs, and at least partially across the back of the thighs. Due to the size of the pad, its floating arrangement on the loose-fitting outer shell provides distinct advantages in preventing interference with player's motion, while still providing substantial protection.

Once the player has the inner pant tightly in place, the outer shell can be drawn up over the inner pant and attached thereto as shown. In one embodiment, the outer shell can be adjusted to one or more different heights. As shown in FIG. 5, the waist of the outer shell has a plurality of loops 146 arranged on the interior thereof. A plurality of regular fit loops are sewn to the interior of the waist band and a plurality of long fit loops are also sewn to the waist band, but only along one edge so that they can be flipped up. A web belt 148 is sized and configured to be weaved through the loops. As shown, in a regular-length setting, the web belt is weaved through all of the regular fit and the long fit loops, but the long fit loops are in the flipped-down position. As shown, when a long-length setting of the pant shell is desired, the long fit loops are flipped up and the web belt is weaved through only the long fit loops.

VELCRO tabs are provided on the outside of the outer shell. VELCRO tabs are also applied to the long-fit loops so as to face outwardly when the long-fit loops are flipped up. Preferably the padded belt of the inner pant is adapted to fold upwardly, exposing complementary VELCRO tabs on its inner surface. The VELCRO tabs preferably are large enough to engage both the VELCRO tabs on the outer shell of the waist band and the tabs on the long fit loops. As such, when the padded belt is closed over the waist band of the outer shell, the VELCRO tabs engage together so that the outer shell is held securely on to the inner pant around the circumference of both the inner pant and the outer shell.

Preferably, the web belt 148 is employed to tighten the outer shell around the waist band so that there is a tight fit about the waist band. The web belt preferably is an infinitely adjustable type so as to be adjusted to whatever tightness the player desires. With the web belt tightened around the player's waist, and the padded belt of the inner pant engaged about the waist band of the outer shell, the outer shell is wholly supported at its waist band, and only connected to the inner pant at the waist band. The remainder of the outer shell is completely disconnected from the inner pant, and free to move independent of the inner pant. Thus, the outer shell has substantial freedom of movement, in contrast to the inner pant, which is in a snug compression-fit about the player's torso and upper legs.

A player intending to wear the hockey pant likely would dress in his hockey gear in a fairly specific order due to the attributes of the pant. For example, preferably the players would first put on the inner pant, including making any adjustments to ensure it is snugly secured about his torso, with all the padding members positioned to appropriately correspond to the body parts they are intended to protect. Rather than next adorn the outer shell, preferably the player would put on his leg pads. The leg pads preferably are put on after the inner pant because it would likely be difficult to draw the tight-fitting inner pant over the leg pads—and because the inner pant is intended to fit about the player's body in the torso area.

With the leg pads in place, the player next preferably puts on his hockey socks, which cover the shin pads, and which are secured at their tops by the sock attachment tabs provided on the leg portions of the inner pant. Preferably the outer shell is put on after the socks, and once the outer shell is in place the skates can be put on. In another embodiment the skates can be put on before the outer shell. To accommodate such action, preferably another embodiment of the outer shell includes a zipper-actuable expansion portion that further enlarges the legs of the outer shell so as to enable the outer shell to be drawn over bulky skates.

The outer shell is formed of a high strength material such as nylon, which is not necessarily known for its stretch capabilities. Also, since the outer shell fits loosely at least through the legs, it typically does not need to be formed of a stretchy fabric, but will still accommodate significant skating movements of the player. However, the outer shell may have stretch zones that employ a stretchy fabric so as to accommodate vigorous skating by the player. For instance, a stretch zone can be provided generally in the player's crotch and in selected areas of high tension or high risk of binding when the player skates so that the outer shell does not inhibit the skating motion.

The outer shell has a pocket for receiving the thigh pad so that the thigh pad can be removed for laundering or the like. In other embodiments, the thigh pad may be permanently encased in the outer shell. The lower thigh pad comprises a hard polycarbonate material and a foam material. The thigh pad is quite large and fits in the thigh portion of the outer shell, which fits loosely over the player's legs. The thigh pad extends across the front of the leg and side of the leg and, in some embodiments, at least part of the back of the leg. Such a large pad would be particularly restrictive if tightly attached to the player. However, since the outer shell is generally loose-fitting in the legs, as the player skates the thigh pad moves readily up and down the legs so that it stays generally in its protective position but does not interfere with skating movement.

The outer shell can incorporate additional padding that will complement the padding of the inner pant. For instance, slash pads and additional ventilated and non-ventilated foams and plastic components can be incorporated into the outer shell to complement the padding of the inner pant. Notably, however, such outer shell padding will not be as closely tied to the body part being protected as are the inner pant pads, because the outer shell is not configured tightly to maintain such pad/body part positioning.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow and of the claims that will be included in any subsequent utility patent application.

The invention claimed is:

1. A pant for a hockey player having a lower spine region, lower ribs, a waist region, a pelvic region with left and right hips, a crotch region, a genital area, and left and right thighs, said pant comprising:

(a) an inner pant comprising a waist portion for covering the waist region of the player, a pelvic portion with front and rear panels for covering the pelvic region of the player, a crotch portion for covering the crotch region of the player and left and right leg portions for covering at least partially the left and right thighs of the player, said inner pant further comprising left and right hip pads for covering the left and right hips of the player, left and right upper thigh pads partially overlapping said respective left and right hip pads for at least partially covering the left and right thighs and being slightly movable relative to said respective left and right hip pads, said inner pant being at least partially made of compression material for applying compression to the player's body and holding said left and right hip pads relative to the respective left and right hips, said inner pant further comprising a pocket for receiving a cup for protecting the genital area of the player and wherein each of said left and right leg portions has a tab mounted adjacent its bottom end, said tap having affixing means for allowing attachment of a hockey sock to said inner pant; and (b) an outer shell at least partially covering said inner pant and being releasably connectable to said waist portion of said inner pant while being otherwise free to move relative to said inner pant, said outer shell having left and right leg sections covering said left and right leg portions of said inner pant, said left and right leg sections having respective left and right lower thigh pads for covering at least partially the left and right thighs of the player.

2. A pant as defined in claim 1, wherein said front panel of said inner pant is at least partially made of a stretch-vent-mesh fabric.

3. A pant as defined in claim 1, wherein a region adjacent said pocket of said inner pant is at least partially made of a stretch-vent-mesh fabric.

4. A pant as defined in claim 1, wherein said left and right leg portions of said inner pant has respective left and right inner leg portions made of a stretch-vent-mesh fabric.

5. A pant as defined in claim 1, wherein said affixing means of each tap has VELCRO hooks.

6. A pant as defined in claim 1, wherein said left and right lower thigh pads of said outer shell partially overlap said respective left and right upper thigh pads of said inner pant.

7. A pant as defined in claim 1, wherein, in use, said outer shell can be adjusted relative to said inner pant from a first height to a second height.

8. A pant for a hockey player having a lower spine region, lower ribs, a waist region, a pelvic region with left and right hips, a crotch region, a genital area, and left and right thighs, said pant comprising:

(a) an inner pant comprising a waist portion for covering the waist region of the player, a pelvic portion with front and rear panels for covering the pelvic region of the player, a crotch portion for covering the crotch region of the player and left and right leg portions for covering at least partially the left and right thighs of the player, said inner pant further comprising left and right hip pads for covering the left and right hips of the player, left and right upper thigh pads partially overlapping said respective left and right hip pads for at least partially covering the left and right thighs and being slightly movable relative to said respective left and right hip pads, said inner pant being made of a first stretchable material and a second stretchable material capable of applying more pressure than said first stretchable material, said pelvic portion and left and right leg portions being at least partially made of said second stretchable material for holding said left and right hip pads relative to the respective left and right hips and said left and right upper thigh pads relative to the respective left and right thighs, said inner pant further comprising a pocket for receiving a cup for protecting the genital area of the player and wherein each of said left and right leg portions has a tab mounted adjacent its bottom end, said tap having affixing means for allowing attachment of a hockey sock to said inner pant; and (b) an outer shell at least partially covering said inner pant and being releasably connectable to said waist portion of said inner pant while being otherwise free to move relative to said inner pant, said outer shell having left and right leg sections covering said left and right leg portions of said inner pant, said left and right leg sections having respective left and right lower thigh pads for covering at least partially the left and right thighs of the player.

9. A pant as defined in claim 8, wherein said front panel of said inner pant is at least partially made of said first stretchable material.

10. A pant as defined in claim 8, wherein a region adjacent said pocket of said inner pant is at least partially made of said first stretchable material.

11. A pant as defined in claim 8, wherein said left and right leg portions of said inner pant has respective left and right inner leg portions made of said first stretchable material.

12. A pant as defined in claim 8, wherein said affixing means of each tap has VELCRO hooks.

13. A pant as defined in claim 8, wherein said left and right lower thigh pads of said outer shell partially overlap said respective left and right upper thigh pads of said inner pant.

14. A pant as defined in claim 8, wherein, in use, said outer shell can be adjusted relative to said inner pant from a first height to a second height.

* * * * *